US010214860B1

(12) United States Patent
Woods

(10) Patent No.: US 10,214,860 B1
(45) Date of Patent: Feb. 26, 2019

(54) HINGED MOULD-AND-DECKLE TOOL FOR MAKING PAPER BY HAND

(71) Applicant: Ann Alaia Woods, Columbus, OH (US)

(72) Inventor: Ann Alaia Woods, Columbus, OH (US)

( * ) Notice: Subject to any disclaimer, the term of this patent is extended or adjusted under 35 U.S.C. 154(b) by 0 days.

(21) Appl. No.: 15/836,861

(22) Filed: Dec. 9, 2017

Related U.S. Application Data

(63) Continuation-in-part of application No. 14/968,590, filed on Dec. 14, 2015.

(60) Provisional application No. 62/111,774, filed on Feb. 4, 2015.

(51) Int. Cl.
*D21J 7/00* (2006.01)

(52) U.S. Cl.
CPC ..... *D21J 7/00* (2013.01)

(58) Field of Classification Search
USPC ..... 162/232, 382, 411
See application file for complete search history.

(56) References Cited

U.S. PATENT DOCUMENTS 1,471,169 A * 10/1923 Kaye ..... D21H 5/06 162/383
4,462,867 A 7/1984 Fuller
5,351,931 A * 10/1994 Houben ..... D21F 13/02 162/382
6,860,461 B1 3/2005 Otani et al.
7,507,315 B1 * 3/2009 Seelenbinder-Apke ..... D21F 13/02 162/382

OTHER PUBLICATIONS

"Build the Pour Mold", Craft, v. 5, 2010, [online], retrieved from the Internet, [retrieved Jul. 5, 2017, <URL: http://makezine.com/projects/papermaking-101/>. (Year: 2010).*
Paper Molds, Timothy Moore Bookbinding Tools, 2006, 8 pages, [online], retrieved from the Internet, [retrieved Jul. 5, 2017], <URL: http://www.timothymooretools.com/molds.html>. (Year: 2006).*
Barrett, Timothy. Japanese Papermaking: Traditions, Tools, and Techniques. New Haven, CT: Weatherhill, Inc., 1983, and Trumble, CT: Floating World Editions, 2005, Chapter 5: "Tools and Equipment," pp. 77-133, and specifically on moulds, pp. 118-121, and drawings by Howard Clark, pp. 95-97.
Fabrication of paper making moulds and deckles: Détails de fabrication. Claudine Latron, Orange, France, 2 pages, in French [online], retrieved from the internet Sep. 7, 2017, <URL: http://www.formesdepapetiers.com.html >.

(Continued)

*Primary Examiner* — Dennis R Cordray
(74) *Attorney, Agent, or Firm* — Ronald J Koch

(57) ABSTRACT

A hinged double-frame mould-and-deckle tool for making paper by hand (a keta in Japanese), comprising two equal-size frame sections, mould below and deckle above, which hold between them a flexible bamboo screen (called a su) on which a fiber web is formed, provided with seating grooves, mortised guide bar, finger openings at either end of the front channel, catch latches positioned for optimal seating of the screen and locking of the frame, removable struts, and beveled deckle. For purposes of this application and its claims, a screen or su is not part of the present invention.

11 Claims, 4 Drawing Sheets

(56) References Cited

OTHER PUBLICATIONS

Papermaking moulds. Robert Walp, [online], retrieved from the internet Sep. 7, 2107, <http://www.chestercreekpress.com>.
Papermaking kits: Pour Handmolds and Dip Handmolds. Arnold Grummer, 2017, 3 pages [online], retrieved from the internet Sep. 7, 2017,<URL: http://www.arnoldgrummer.com.html>.
Papermaking crafts. "How to Make a Mold and Deckle from Wood," [also from picture frames and plastic canvas], Aunt Annie's Crafts/Paper making Crafts, © 2017, 3 pages [online], retrieved from the internet Sep. 7, 2017, <http://www.auntannie.com.html>.

* cited by examiner 15
16
17
15

9
15
12
2
11
15
3
5
4
FIG. 3B (Left)
11
14
5
2
12
9
13
3
4
FIG. 3C (Right)

HINGED MOULD-AND-DECKLE TOOL FOR MAKING PAPER BY HAND

BACKGROUND OF THE INVENTION

1. Field of the Invention

The present invention relates generally to the centuries-old art of making paper by hand with a two-part hand-held apparatus known as a suketa, and specifically to one part of that toolset known as a keta, which comprises a hinged double frame consisting of two frame sections, a lower mould section and an upper deckle section, that hold between them the second part of the toolset, a su, or flexible bamboo screen on which a fiber web is formed.

2. Description of the Prior Art

Hinged mould-and-deckle frames (ketas) have long existed as one component of the apparatus used in the Japanese paper-making tradition. Making paper began in the 2nd century C.E. in China and moved thence to Japan, where it became an art form and eventually a major industry, and finally to Western Europe late in the Middle Ages, remaining essentially a hand operation until the Industrial Revolution.

The basic tools for making paper by hand throughout the world are similar in principle: a frame device that houses a screen is dipped into a vat of pulp-water so a fiber web can form on the screen as excess water is removed. The individual parts of the hand-held tools used in each tradition, however, diverge considerably in both construction and manner of use.

In the Western tradition, the basic toolset consists of two separate frame sections, a mould to which is permanently affixed a stiff mesh (traditionally wire screening; more recently also of synthetic materials, such as nylon) and an entirely separate open frame, deckle, that fits over the mould as a containing device for the sheets being formed on the screen. Typical examples of well designed and well constructed Western-style frames (both laid and wove) are those made by Timothy Moore (http://www.timothymoore-tools.com.html) and by Claudine Latron (http://www.formesdepapetiers.com).

Once a fiber web has formed, the deckle is removed from the mould completely so the formed sheet can be forced off the mesh screen from behind with a sponge or towel to transfer (couch) it to a drying felt. In this system, drying felts must be inserted between all individual sheets of paper.

The hand-held tool (suketa) of Japanese tradition likewise has two components, but differs from its Western counterpart in that the first component, the keta, comprises two equal-sized frame sections hinged together, the upper frame serving as the deckle and the lower as the mould. A hinged keta holds and supports within itself the second component, a screen called the su, on which the fiber web forms. In contrast to Western practice, the su is both independent and flexible, traditionally made of very fine bamboo strands laid side by side and sewn together with silk thread to form a highly pliant mat. Importantly, a keta must be able to hold such a pliant su rigid within its frame sections as the pair are dipped into a vat to scoop up pulp-water and form a sheet, as any slack in the screen will negatively affect the quality of the paper produced.

Finally, once the paper sheet has been formed, the su is removed from the keta completely and brought to the couching stand where the fiber web it holds is rolled off its surface. The addition to the vat water of a formation aid, called neri, both controls the rate of water drainage and eliminates the need for drying felts, allowing sheets to be stacked directly on top of each other. A drawing of a large traditional Japanese keta—large enough in its dimensions to merit handles mounted atop its deckle and clasps on its front rails—can be found at http://www.awagami.com/tools.html.

Western-style moulds and deckles are quite accessible to paper artists today, from widely circulated instructions for building simple homemade versions out of wood, old picture frames, or even of cardboard and plastic canvas (at http://www.auntannie.com/Papermaking), to the finely crafted moulds and deckles for making quality laid and wove-style papers already cited. Ingenious variations on the Western-style mould-and-deckle system can be found early in the 20th century, in U.S. Pat. No. 1,471,169, issued to Kaye, Oct. 16, 1923, for deckle inserts to make designs in paper, wood, and leather, and in U.S. Pat. No. 1,560,861, issued to Rivage, Nov. 10, 1925, to produce deckled edges in previously manufactured paper or cardboard stock in imitation of handmade paper. More recent variations on the mould-and-deckle tool itself include one-piece dip handmolds from Arnold Grummer, available at http://www.amoldgrummer.com/medium-dip-handmold.html. Variations on the pour-mould concept, generally for creating 3-D forms with paper pulp, can be found in U.S. Pat. No. 5,351,931, issued to Houben on Oct. 4, 1994, and in U.S. Pat. No. 7,507,315, issued to Seelenbinder-Apke, et al., on Mar. 24, 2009, as well as on the internet, at http://amoldrummer.com/products/papermakinq-kits/pour-handmolds.html.

Such is not the case with Japanese-style hand paper-making frames. Of the two I could find offered commercially, one is a student kit which includes a simple hinged keta consisting of two identical frame sections for the mould and deckle; it is available in a single size only, 8¼"×11¾" (at http://carriagehousepaper.com/nagashizuki-papermaking-kit>). The other (http://www.awagami.com) offers a keta, available in two sizes, 12"×14" and 5"×7", which likewise consists of identical frame sections for the mould and deckle, with smooth facing surfaces. None can be found offered in large sizes or even in a larger range of sizes, and none incorporates any added features. Moreover, when I went in search of such a hinged frame and screen for my personal use during a visit to Japan in 2011 through paper artist contacts recommended by noted American papermakers, I learned that frames were no longer available and that a su, which Barrett had written in 1983 would cost about $300, had now risen to $800 (student grade) or $1000 (professional), with a wait time of over a year.

SUMMARY OF THE INVENTION

In view of the limited options for obtaining Japanese-style hinged mould-and-deckle frames and the disadvantages of those that are available, the state of the prior art with respect to this tool must be said to be poor. The general purpose of the present invention, which will be described subsequently in greater detail, is to provide not simply a basic apparatus, but an improved tool in the Japanese tradition which has all the benefits of the prior art without the disadvantages.

Whichever tradition or system of making paper by hand is followed, the basic movements involved in sheet forming are repetitive. Once mastered, productivity increases only with the reduction or elimination of unnecessary or inefficient movements in the lead up to and forming of each sheet. The several improvements claimed herein are directed at increasing productivity by reducing inefficiencies in the process unaddressed by the prior art that affect both the time and physical effort expended by an operator in forming sheets. One example of inefficiency is extra time taken to position a screen properly within its frame; another is the effort needed to grip the frame sections and screen together over a long sheet run, either with the hands alone as is required by all Japanese-style frames now commercially available, or with the aid of clasps mounted on the front rails of large traditional frames that then require additional hand movements to lock; and still a third is the degree of effort involved in casting off excess pulp-water after each sheet is formed.

To achieve these efficiencies, the present invention consists of several improvements to the traditional structure of a keta that directly attempt to overcome shortcomings in the prior art, especially those that relate to the nature of the hand paper-making process and its many repetitive steps, including, but not limited to, positioning the su accurately, keeping the su taut and firmly in place throughout the sheet-forming process, and reducing energy expended in casting off excess pulp-water after each sheet is formed.

The foregoing has described the principles and goals of the present invention in a very general way, in order that the detailed description of the preferred embodiments of the invention that follows may be better understood and appreciated in relation to the prior art. It is to be understood that there are specific features of the present invention not mentioned here that will be included in the detailed description as well as in the listed claims.

It is also to be understood that the present invention is not limited in its application to the details of construction or to the arrangements of components found in the description provided below or illustrated in the drawings. The invention is capable of other embodiments and of being practiced in various ways. Further, the terms and language that have been used here are for descriptive purposes only and should not be understood as limiting.

As such, those skilled in the art will appreciate that the conception, upon which this disclosure is based, may readily be used as a basis for designing other structures, methods, and systems for carrying out the several goals of the present invention. It is therefore important that the claims be regarded as including such equivalent constructions insofar as they do not depart from the spirit and scope of the present invention.

Further, the purpose of the Abstract provided herein is to enable the U.S. Patent and Trademark Office and the public generally, and specifically the practitioners in the art who are not familiar with patent or legal terms or phraseology, to determine from a quick inspection the nature and essence of the technical disclosure of the application; it is not intended to define the invention in the application, which is measured by the claims, nor is it intended to be limiting as to the scope of the invention in any way.

Therefore, it is an objective of the present invention to provide a new and improved hinged mould-and-deckle tool for making paper in the Japanese style that draws on the principles and advantages of the prior art while simultaneously overcoming some of its disadvantages.

Another objective of the present invention is to provide a new and improved hinged mould-and-deckle tool for making paper in the Japanese style that is of durable and reliable construction.

A further objective of the present invention is to provide a new improved hinged mould-and-deckle tool for making paper in the Japanese tradition that is marketed in multiple sizes and can be tailored to an individual artist's needs.

Still another objective of the present invention is to provide a new and improved hinged mould-and-deckle tool for making paper in the Japanese tradition that, in addressing issues of labor and materials, including but not limited to using prefabricated or machine-fabricated instead of hand-fabricated hardware and to providing gainful employment for su artisans, makes a well-designed tool available commercially to artists and interested individuals in the buying public.

These, as well as other objectives of the invention, are explained with greater specificity in the attached claims and description that form a part of this disclosure. A better understanding of the invention, its operating advantages as well as its range of uses and applications, will be gained by reference to the accompanying drawings and the detailed description, in which the preferred embodiments of the invention are presented.

BRIEF DESCRIPTION OF THE DRAWINGS

FIG. 3B is a side view of the left side rails of the closed double frame, showing the guide bar seated into the mould with a screen in place behind it, only its handles visible in the front and rear channels.

FIG. 3C is a side view of the right side rails of the closed frame, showing a screen sandwiched between the mould and deckle.

REFERENCE NUMBERS IN DRAWINGS

Figure 3A:
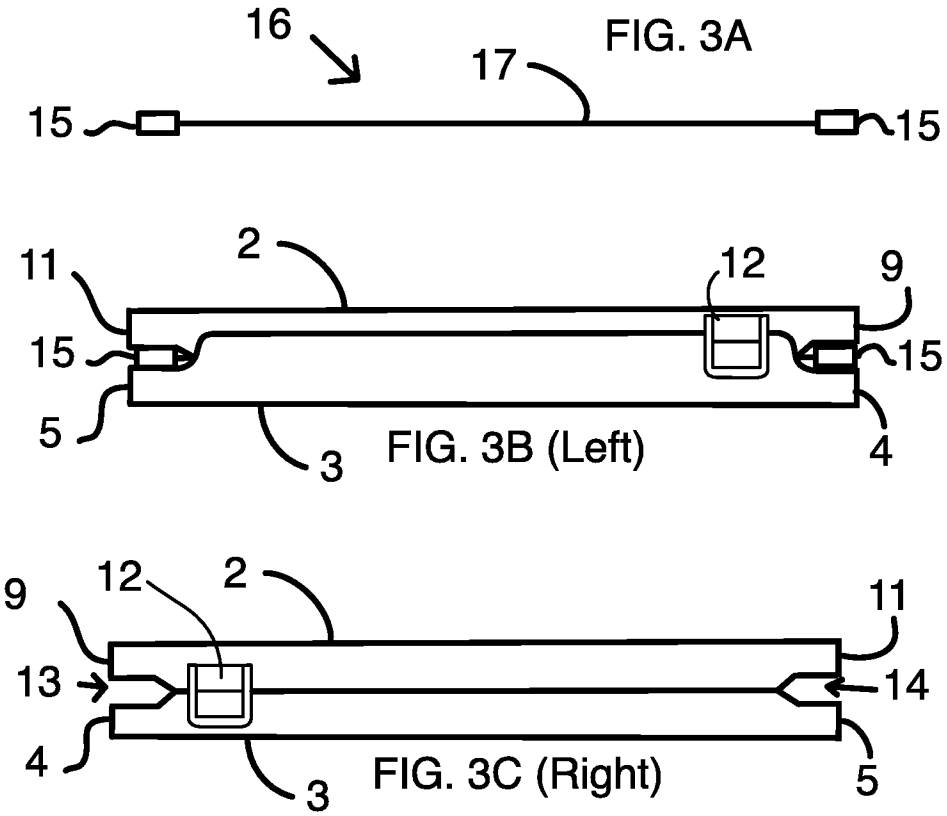
FIG. 3A is a side view of a traditional Japanese su or screen, not included as part of the present invention.

1 hinged double frame (suketa)
2 deckle (upper frame)
3 mould (lower frame)
4 front rail of mould (3)
5 rear rail of mould
6 groove along top surface of front rail (4) of mould (3)
7. groove along top surface of rear rail (5) of mould
8 groove along underside of front rail (9) of deckle (2)
9 front rail of deckle
10 groove along underside of rear rail (11) of deckle (2)
11 rear rail of deckle
12 cooperating latch member
13 channel formed, with frame closed, by grooves in front rails (4) and (9). FIG. 3C
14 channel formed, with frame closed, by grooves in rear rails (5) and (11). FIG. 3C
15 handle(s) of a su (16), indicated in FIGS. 3A and 3B
16 su, or screen (not included as part of the present invention). FIG. 3A
17 flexible bamboo screen of a traditional su (16)
18 guide bar

Figure 2C:
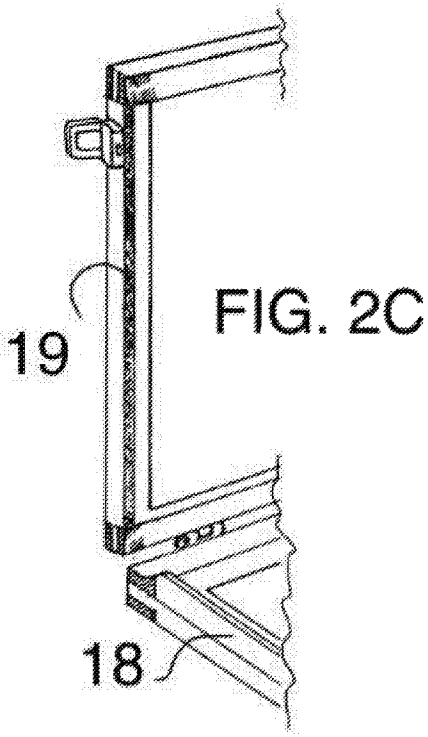
FIG. 2C is a partial perspective view of the left side rails, showing the guide bar in the mould and the guide-bar recess routed into the deckle.
Figure 4:
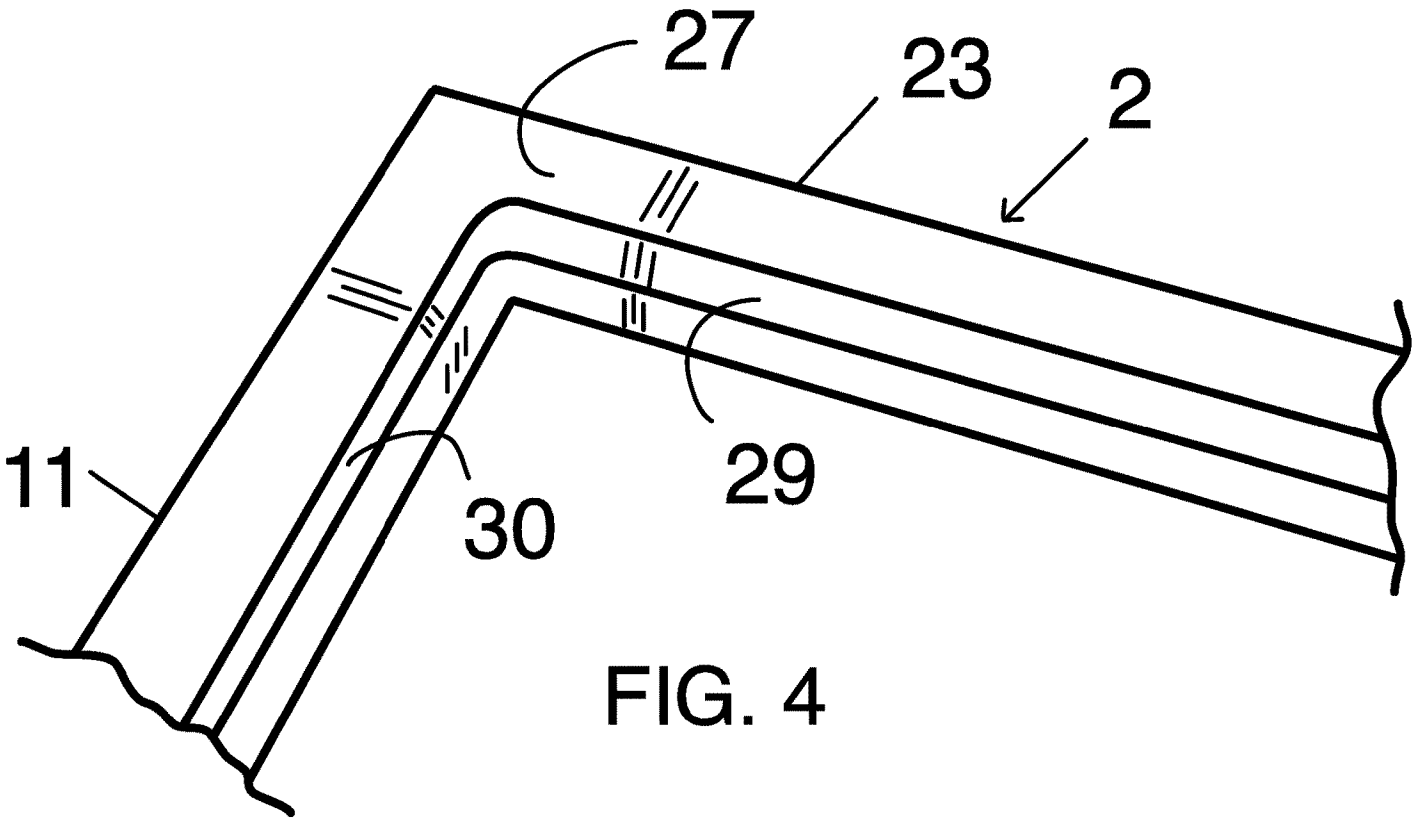
FIG. 4 is a partial view of the beveling that runs along the full length of the top inside edges of the deckle's rear and side rails. The deckle's right side rail, similarly beveled, is not shown.

19 guide bar recess in left side rail (22) of deckle (2). FIG. 2C
20 struts
21 hinge
22 left side rail of deckle (2)
23 right side rail of deckle
24 left side rail of mould (3)
25 right side rail of mould
26 top side of the left side rail (22) of deckle (2). FIG. 4
27 top side of the right side rail (23) of deckle (2) (not shown)
28 beveled top inside edge (26) of left side rail (22) of deckle (2). FIG. 4
29 beveled top inside edge of right side rail of deckle (2) (not shown).
30 beveled top inside edge of rear rail (11) of deckle (2).
31 Rounded upper end of a strut (20).
32 Slot for inserting slat strut (20)

DESCRIPTION OF THE PREFERRED EMBODIMENT OF THE INVENTION

Although the invention here claimed, and as outlined in earlier sections of this disclosure, relates generally to the two-part toolset associated with the Japanese art of making paper by hand called a suketa, it is concerned specifically with improvements to just one component of that toolset, the hinged double frame known as a keta. In operation, the purpose of a keta is to hold the second component of the toolset, a flexible bamboo screen called a su, straight and taut as a fiber web or paper sheet is being formed upon it. It is to be understood, however, that while a su or screen is inseparable from a keta in the process of making paper, and while It will be necessary to refer to a su throughout the following description of the preferred embodiment of the improved hinged mould-and-deckle frame, a su is not a part of the present invention. With reference therefore to the drawings provided, a new and improved hinged mould-and-deckle frame that embodies the precepts, principles, and goals of the present invention will here be described.

Cutting Grooves in the Rails of the Mould

Traditional Japanese ketas have been described as having grooves carved in the underside of the front and rear rails of the upper frame section, that is, in the deckle (Barrett, op. cit., p. 97), but not in the lower section or mould. In all contemporary hinged double frames that I have been able to find, however, the deckle and mould sections are (apart from struts inside the lower mould frame section), identical in structure and flat on both facing surfaces. By contrast, the mould and deckle sections of the present invention vary substantially both in structural details and function (as shown in FIGS. 3B and 3C as well as in FIG. 1), each frame section comprising one or more of the improvements claimed, as will be described herein and referenced in the drawings.

Each frame section is constructed of four pieces of wood, secured at the corners to form a rectangle. In this embodiment, the corners of both frame sections are secured with tongue and groove joints, and all rails are of cypress (chosen for its light weight, strength, and affinity to water, and selectively cut to avoid the heartwood). The preferred embodiment of small to medium-sized frames (30" or less wide) is front and rear rails of both mould and deckle of 1"×⅞", and side rails of ⅞"×⅞". It is to be understood that the length of the rails will vary to according to variations in the measurements of the handmade screen or su that the hinged double frame is being built to hold.

For frames built to hold screens wider than 30", rail thickness should be increased slightly to insure stability. Moreover, frames greater than 30" in width, because they require more than a comfortable arms' stretch, have traditionally been fitted with top handles such as those shown in the Awagawi illustration (http://www.awagami.com/awa-washi/tools.html). Such top handles could be added to frames encompassed by the present invention that are wide enough to require them, but such handles are not a part of the present invention.

Figure 1:
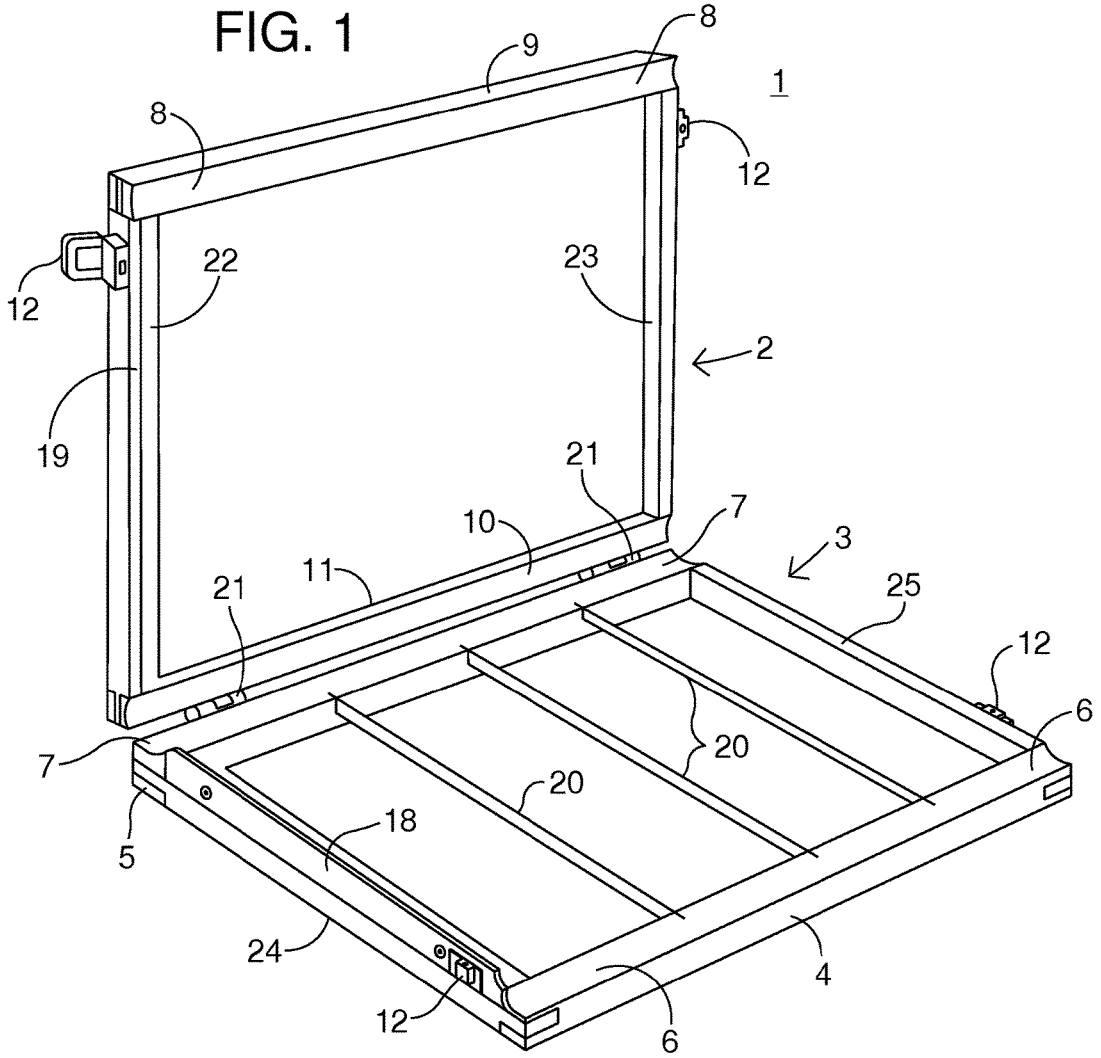
FIG. 1 is a perspective view of the hinged double frame, illustrating several of the claimed improvements.

Once the frame sections have been secured, grooves (6) and (7) are carved along the entire length of the top surface of both front and rear rails (4) and (5) of the mould (3) (FIG. 1). Adding grooves to the front and rear rails of the mould allows gravity to assist in quickly and accurately positioning a screen in the frame from front to back.

In this embodiment, grooves (6) and (7) extending the full length of the front and rear rails of the mould are each of sufficient width and depth to properly nest the handle of a su. For a traditional su such as that shown in Barrett (op. cit., p. 97), this would be as much as three-quarters of the width of the rail wide and an eighth of an inch deep. The remaining one quarter rail width along the top surface of each rail is sanded, such that the groove will angle up and outward toward the inside of the frame, as shown in FIG. 3C, to accommodate the angled shape of su handles. In like manner, grooves (8) and (10), are carved into front and rear rails (9) and (11) of deckle (2). When the deckle is positioned on top of the mould, as in FIGS. 1 and 3C, groove (6) in the mould will be seen to cooperate with groove (8) in the deckle to form front channel (13), just as groove (7) in the mould and groove (10) in the deckle will cooperate to form rear channel (14). These channels hold the handles of a su (screen) securely.

Cutting, Installing, and Mortising the Guide Bar into the Mould and Deckle

The guide bar in this embodiment consists of a thin wood rail, just long enough to fit the space between front and rear rails (4) and (5) of the mould (see FIGS. 1 and 3B). Before being installed, the ends and top edges of the guide bar have been rounded to avoid damage during operation to either a su or a fiber web being formed. A routing along the outer top edge of side rail (24) of mould (3), just large enough to accommodate the guide bar rail and ending where said side rail meets the front and rear rails of the mould, should be implied, from FIGS. 1, 2B, and especially 3B, as preparation for seating the guide bar (18) into the mould.

As shown in FIGS. 1 and 2C, a cooperating groove (19) is routed into the left side rail (22) of deckle (2), to provide a mortise for the guide bar to slip into as the deckle closes onto the mould, keeping the guide bar out of the way of the operator's grip and thereby eliminating a potential source of hand fatigue. In another equally preferable embodiment, said guide bar could be installed in the right side rail (25) of the mould, with a cooperating mortise in the right side rail (23) of deckle (2), to accommodate, for example, a left-handed user's preferences.

All nails used, in securing both the corners of the frame and the guide bar, have been recessed, then concealed with wood putty, to reduce the chances of their rusting or of working loose and potentially damaging both the su and the frame itself.

FIGS. 3B and 3C, thus also make clear that, in contrast to other hinged mould-and-deckle frames available, the two frame sections of the present invention will differ substantially in structural details and features.

Finger-Hole Openings

A further improvement claimed in the present invention are the finger holes beveled at either end of front channel (13), shown in FIG. 3C. These become visible as the deckle is brought down over the screen and mould and are just large enough to allow a finger of each hand to reach in to stretch the front handle (15) of the su forward into its final position, allowing the deckle to drop closed over the mould and the cooperating members of the catch latches at the sides of the frame to engage. The benefit of this improvement will be evident to those skilled in the art, since a su is wet when thus placed within the keta, its silk threads causing it to begin shrinking between handles. Being able to pull against this action to insure that the su is in a fully stretched, taut position as the two frame sections are being secured, is essential to creating a high quality paper sheet.

Preparing the Mould for Struts

Figure 2A:
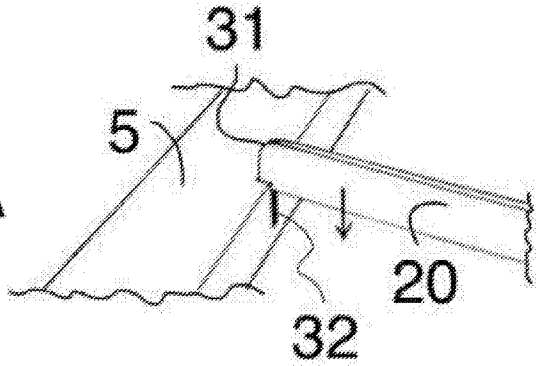
FIG. 2A is a partial perspective view of the mould showing how a strut slides in and can be removed.

Slat struts are seated into slots that have been cut opposite one another in front and rear rails (4) and (5) of mould (3), as shown in FIGS. 1 and 2A, and spaced to divide the width of the open area roughly evenly, though their precise position must be based not on a mathematical division of space but on the struts not lining up under any of the screen's thread-lines. For this embodiment, three slots have been thus cut to accommodate three semi-rigid slat struts made of 1/16"×½" aluminum railing. Slat struts set into the frame in this manner will reach the underside of the screen, and thus properly support it, unlike more commonly seen dowel struts. Not being either glued or otherwise permanently affixed to the mould, slat metal struts can easily be removed and later returned, without damage to the frame, according to the artistic aims of the paper maker. Aluminum railing has been chosen as the preferred material for struts for the combination of properties it provides, including, but not limited to, the thin edge it presents to the screen (like the traditional wire), a sufficient width to preclude any warping along its top edge where the slat meets the screen (unlike wire), strength, semi-rigidity, light weight, resistance to rusting, and low friction index (easily removed and reset without damage to the frame), as well as reasonable cost, general availability, and low replacement cost if damaged or lost. It is to be understood that other types of metal railing could be used in other embodiments, as long as they provided similar benefits. As seen in FIG. 2A, the ends of said metal struts (31) have been beveled where they slide into the slots (32) in mould (3) and their top corners have been rounded off to eliminate any sharp edges that could damage the screen, the frame, or even the fiber web being formed.

Struts are best set into final position after all work on frame sections is completed, including beveling of the deckle as described below, assembling, and finishing.

Beveling the Deckle

A further improvement claimed as part of the present invention (and shown in FIG. 4) consists of deeply beveling the full length of the top inside edge (29) of rear rail (11) of deckle (2), and, in like manner, the full length of the top inside edges (28) [and (29), not shown], of both side rails (22) and (23) of the deckle, and relates to the several throwing motions of hands and arms needed to remove excess pulp-water remaining inside the frame after a sheet of paper is formed. Removing the squared angles on the inside edges of the deckle's rails helps reduce the amount of effort required in those casting off motions, even as it increases the effectiveness of the effort that is made. In this embodiment, the beveling creates sloped angles of about 45 degrees that are, in standard-sized ketas, approximately ½" wide along the rear rail (11), and at least ¼" wide along each of side rails (22) and (23).

Finishing

In this embodiment, all mould and deckle surfaces and rail edges are sanded smooth before being treated with a wood finish that seals the wood, further improving the tool's resistance to water damage and thus its longevity.

Assembling Frame Sections; Adding Hardware

Hinges

Mould and deckle sections are connected by a plurality of hinges that allow them to open and close freely and function as a single unit. FIG. 1 shows a hinged double frame with two hinges, the number preferred for ketas less than 30" in width. In this embodiment, the hinges are four-screw, of solid brass. In another embodiment, hinges might be cast and brass coated. In still another embodiment, hinges of stainless steel could be used. All are chosen for their resistance to rusting. Frames built for screens wider than 30" will have a third hinge added to insure stability. Notwithstanding the foregoing details, hinges are to be understood as integral to the traditional double-frame structure of a keta apparatus and, as such, are not of themselves among the improvements in the present invention.

Catch Latches

Clasps, two in number, have long been included on traditional Japanese ketas of large size, but they were not found on smaller frames, and they are not to my knowledge included on any other hinged double frames available commercially today. As illustrated in Barrett, op. cit., p. 97, where they are described as hand forged from 2 mm copper sheeting, such clasps are mounted on the underside of the front rail of the mould section of larger frames and must be swung upward to grip around both front rails. Additionally, in order to maintain their gripping ability, a wear-strip, also copper, has had to be inset into the top edge of the front rail of the deckle. (See also the drawing of a large keta frame shown on the Awagami Factory website, cited herein.) Apart from issues of added time and labor raised by hand fabrication of the sort of clasps described by Barrett, and even if machined versions were available now, it is important to note that the way such clasps function requires that they be found in sizes exactly fitting the width of the two front rails used for a particular frame. Equally important is that, while such clasps close, they do not truly lock.

The present invention uses catch latches instead. A "catch latch" is a type of mechanical fastener in which cooperating members first catch or engage (such as by a bar in one member dropping into a groove in the other), then lock by means of a hinged loop on one member flipping around the catch mechanism of both members to hold the two sections securely together.

Figure 2B:
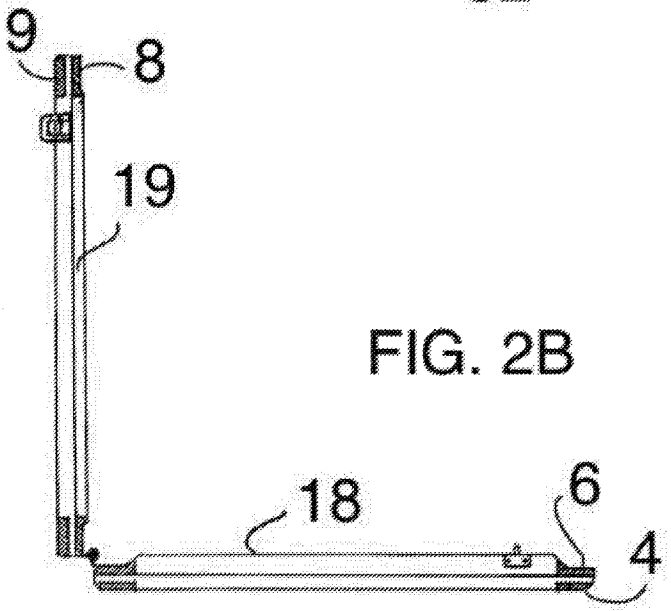
FIG. 2B is a side view of the left side rails with the frame opened, showing the guide bar in the mould, and indicating the guide-bar recess in the deckle.

FIGS. 1 and 2B show the two separate members of a catch-style latch of the type used in this improved mould-and-deckle frame in place near the front end of the left side rails.

It is to be understood that a matching catch latch has been similarly installed on the right side rails. FIG. 3C shows such a latch engaged and fully locked.

Catch latches are affixed on cooperating side rails (22) and (24) and (23) and (25) and, in this embodiment, are positioned back from the front of the frame about 1¾". They are also installed with the looped member affixed to the deckle, allowing gravity to help their cooperating members catch as the deckle is lowered into place so they can be locked at the same time that the su is finally pulled with the fingers into position. Thus placed, such catch latches not only accomplish the same end as traditional-style clasps on the front rails of a large frame of securing the two frame sections together, but their placement on the side rails near the front of the frame, allows them to drop down or be easily flipped down into locked position within the same set of hand movements that are involved in closing the frame and pulling the screen forward to its optimally stretched position. This efficiency of movement is not possible with traditional front-end clasps. Other advantages of such catch latches, beyond pre-fabrication and availability, include their high level of security in locking the frame closed and their ease of application to any size frame without regard to the thickness of frame rails. In this preferred embodiment, catch latches are of solid brass, for rust resistance. Other embodiments could include catch latches that are brass-coated or made of any other reasonably rust-resistant material.

Notwithstanding the above discussion of clasps and latches, it is to be understood that neither clasps nor latches are in and of themselves claimed as new. Only the application of catch latches to this tool and their positioning on the apparatus for maximum efficiency in use are claimed as new and therefore part of the present invention.

With respect to the manner of usage and operation of the present invention, this should be evident from the above description, which should be sufficient.

From the above description also, it is to be understood that the optimal dimensional relationships for the parts of the invention, including variations in size, materials, shape, form, function and manner of operation, assembly and use, are deemed to be readily apparent and obvious to one skilled in the art and, accordingly, all equivalent relationships to those illustrated in the drawings and described in the specification are intended to be encompassed by the present invention.

The foregoing is therefore to be understood as illustrative only of the principles of the invention. As such, since numerous modifications and changes will readily occur to those skilled in the art, it is not desired to limit the present invention to the exact construction and operation shown and described herein and, in consequence, all suitable modifications and equivalents that may be resorted to fall within the scope of the invention.

What is claimed is:

1. A hinged mould-and-deckle frame (keta) for use in conjunction with a flexible screen (su) comprising two handles in making paper by hand, comprising:

a mould having front, rear, and opposing side rails, each having a length and a width, and a top surface;

a deckle having front, rear, and opposing side rails, each having a length and a width, and a top surface and a bottom surface;

the rear rails of the mould and the deckle being hingedly connected to form a double frame configured to be operable between a closed position, in which the bottom surface of the deckle overlays and is in close proximity to the top surface of the mould, and an open position, in which the bottom surface of the deckle does not overlay the top surface of the mould;

the top surface of each of the front and rear rails of the mould having a groove disposed along the entire length thereof at the front and rear sides, respectively, of the mould;

the groove in the top surface of the front rail of the mould having a width that will accommodate the width and shape of a su handle;

the groove In the top surface of the rear rail of the mould having a width that will similarly accommodate the width and shape of a su handle;

the bottom surface of each of the front and rear rails of the deckle having a groove disposed along the entire length thereof at the front and rear sides, respectively, of the deckle;

the groove in the bottom surface of the front rail of the deckle having a width that will accommodate the width and shape of a su handle;

the groove In the bottom surface of the rear rail of the deckle having a width that will similarly accommodate the width and shape of a su handle;

the groove in the top surface of the front rail of the mould being widened out at either end;

the groove in the bottom surface of the front rail of the deckle being widened out at either end;

wherein, when the frame is in the closed position, the grooves in the front rails of the mould and the deckle cooperate to form a front channel, and the grooves in the rear rails of the mould and the deckle cooperate to form a rear channel, each channel configured to hold a handle of a su securely, and wherein the widened ends of the grooves of the front rails of the mould and the deckle cooperate to form an opening large enough to allow a finger to be inserted of at either end of the front channel;

a guide bar disposed in the top surface of a side rail of the mould;

the guide bar in the side rail being mortised into the cooperating side rail of the deckle when the frame is in the closed position;

the frame being restrainable in the closed position by two cooperating catch latches disposed on both sides of the frame, each catch latch disposed on an outside surface of the side rails of the mould and deckle, proximate the front rails of the mould and deckle;

semi-rigid slat struts, each being fitted into slots disposed in the front and rear rails of the mould;

beveling along a top inside edge of the rear rail; and beveling along a top inside edge of the opposing side rails of the deckle.

2. The hinged mould-and-deckle frame of claim 1, wherein the catch latches are a made of rust-resistant material.

3. The hinged mould-and-deckle frame of claim 1, wherein the one or more semi-rigid slat struts are removable.

4. The hinged mould-and-deckle frame of claim 1, wherein the one or more semi-rigid slat struts are made of metal.

5. The hinged mould-and-deckle frame of claim 1, wherein the one or more semi-rigid slat struts are made of a rust-resistant metal.

6. The hinged mould-and-deckle frame of claim 1, wherein the ends of each semi-rigid slat strut are sanded smooth.

7. The hinged mould-and-deckle frame of claim 1, wherein the top corners of each semi-rigid slat strut are rounded off.

8. The hinged mould-and-deckle frame of claim 1, wherein the catch latches are made of solid brass.

9. The hinged mould-and-deckle frame of claim 1, wherein the catch latches are made of brass coated material.

10. The hinged mould-and-deckle frame of claim 1, wherein the catch latches are made of stainless steel.

11. The hinged mould-and-deckle frame of claim 1, wherein the one or more semi-rigid slat struts are made of aluminum.

* * * * *